US009500446B2

(12) United States Patent
Crouch et al.

(10) Patent No.: US 9,500,446 B2
(45) Date of Patent: Nov. 22, 2016

(54) MULTISEGMENTED TOROIDAL MAGNETIC FIELD PROJECTOR

(71) Applicant: RAYTHEON COMPANY, Waltham, MA (US)

(72) Inventors: David D. Crouch, Rancho Cucamonga, CA (US); Keith G. Kato, Rancho Cucamonga, CA (US)

(73) Assignee: RAYTHEON COMPANY, Waltham, MA (US)

( * ) Notice: Subject to any disclaimer, the term of this patent is extended or adjusted under 35 U.S.C. 154(b) by 220 days.

(21) Appl. No.: 14/515,289

(22) Filed: Oct. 15, 2014

(65) Prior Publication Data

US 2016/0109211 A1 Apr. 21, 2016

(51) Int. Cl.

| | |
|---|---|
| ***H01F 1/00*** | (2006.01) |
| ***F41H 11/12*** | (2011.01) |
| ***F42D 5/04*** | (2006.01) |
| ***H01Q 9/28*** | (2006.01) |
| ***H01Q 21/26*** | (2006.01) |

(52) U.S. Cl.

CPC ..... *F41H 11/12* (2013.01); *F42D 5/04* (2013.01); *H01Q 9/28* (2013.01); *H01Q 21/26* (2013.01)

(58) Field of Classification Search

CPC ..... H01Q 1/38
USPC ..... 335/296; 333/242; 343/772; 89/1.13
See application file for complete search history.

(56) References Cited

U.S. PATENT DOCUMENTS

| | | | | |
|---|---|---|---|---|
| 2,951,222 | A * | 8/1960 | Marie | H01P 1/02 333/249 |
| 3,898,599 | A | 8/1975 | Reid et al. | |
| 4,087,322 | A | 5/1978 | Marcus | |
| 4,564,826 | A * | 1/1986 | Wiesenfarth | H01P 1/02 333/249 |
| 4,786,913 | A * | 11/1988 | Barendregt | H01P 1/064 333/248 |
| 5,505,780 | A | 4/1996 | Dalvie et al. | |
| 5,668,342 | A | 9/1997 | Discher | |
| 6,794,962 | B2 * | 9/2004 | Chambelin | H01P 1/022 333/249 |
| 6,799,499 | B2 * | 10/2004 | Seregelyi | F41H 11/12 102/402 |
| 8,390,402 | B2 * | 3/2013 | Kunes | H01P 3/14 333/241 |
| 2005/0040918 | A1 * | 2/2005 | Kildal | H01P 1/2005 333/239 |
| 2009/0243766 | A1 * | 10/2009 | Miyagawa | H01P 1/027 333/249 |

FOREIGN PATENT DOCUMENTS

| | | |
|---|---|---|
| WO | WO 96/41398 A1 | 12/1996 |

OTHER PUBLICATIONS

Written Opinion of the International Searching Authority for International Application No. PCT/US2015/045153 filed Aug. 13, 2015, Written Opinion of the International Searching Authority mailed Oct. 27, 2015 (6 pgs.).

International Search Report for International Application No. PCT/US2015/045153, filed Aug. 13, 2015, International Search Report dated Oct. 19, 2015 and mailed Oct. 27, 2015 (3 pgs.).

* cited by examiner

*Primary Examiner* — Alexander Talpalatski
(74) *Attorney, Agent, or Firm* — Lewis Roca Rothgerber Christie LLP

(57) ABSTRACT

A system for triggering improvised explosive devices (IEDs) with an alternating magnetic field. In one embodiment, the magnetic field is produced by a magnetic field projector in the shape of one-half of a torus, the half-torus being composed of several conductive segments referred to as toroidal wedges. A poloidal current flows in each toroidal wedge, producing a magnetic field that is projected by the half-torus. The magnetic field may induce a current, producing heating, in a conductive loop in an IED and triggering the IED.

19 Claims, 6 Drawing Sheets

MULTISEGMENTED TOROIDAL MAGNETIC FIELD PROJECTOR

BACKGROUND

1. Field

One or more aspects of embodiments according to the present invention relate to a system for projecting a low-frequency oscillating magnetic field, and more particularly to an electromagnetic system for triggering improvised explosive devices (IEDs) using an alternating magnetic field.

2. Description of Related Art

Improvised explosive devices are explosive devices typically deployed against troops or civilians. An IED may be hidden under a roadway along which the intended targets are expected to travel, and triggered remotely, e.g., by an observer, or locally, e.g., by a pressure-sensitive switch which detects the presence of the targets.

IEDs triggered by pressure sensitive switches may be made harmless by triggering them with a vehicle pushing a heavy armored roller, or "mine roller" that may be driven ahead of troops on foot or ahead of other more vulnerable targets. If, however, an IED is designed to be remotely triggered, or remotely armed, after a mine roller has passed, the mine roller may fail to trigger it and it may remain a threat.

Thus, there is a need for a more reliable system for triggering IEDs.

SUMMARY

In one embodiment, a system for triggering improvised explosive devices with an alternating magnetic field includes a magnetic field projector in the shape of one-half of a torus. The half-torus is composed of several conductive segments referred to as toroidal wedges. A poloidal current flows in each toroidal wedge, producing a magnetic field that is projected by the half-torus. The magnetic field may induce a current in a conductive loop in the IED, heating a bridge wire within the detonator of the IED to a sufficiently high temperature to trigger a detonator in the IED.

According to an embodiment of the present invention, there is provided a system for projecting an oscillatory magnetic field, the system including: a plurality of conductive toroidal wedges; each toroidal wedge being a section of tube having two substantially planar ends, at least one of the substantially planar ends having a normal oblique to the centerline of the tube, the section of tube having a slit extending between the two substantially planar ends, and a plurality of non-conductive spacers; the toroidal wedges being assembled to form an assembly substantially in the shape of a portion of a torus.

In one embodiment, the section of tube forming a toroidal wedge of the plurality of toroidal wedges has a cross section that is substantially circular.

In one embodiment, the section of tube forming a toroidal wedge of the plurality of toroidal wedges has a cross section that is substantially rectangular.

In one embodiment, the slit in the section of tube forming a toroidal wedge of the plurality of toroidal wedges is substantially parallel to the centerline of the section of tube.

In one embodiment, the slit in the section of tube forming a toroidal wedge of the plurality of toroidal wedges is substantially in a plane parallel to the normals of the substantially planar ends of the section of tube.

In one embodiment, the angle between the normals of the substantially planar ends of the section of tube forming a toroidal wedge of the plurality of toroidal wedges is less than 45 degrees.

In one embodiment, the angle between the normals of the substantially planar ends of the section of tube forming a toroidal wedge of the plurality of toroidal wedges is greater than 10 degrees.

In one embodiment, the minor diameter of the portion of the torus is greater than 4 inches and less than 8 inches.

In one embodiment, the major diameter of the portion of the torus is greater than 12 inches and less than 24 inches.

In one embodiment, the tube diameter of the portion of the torus is greater than 4 inches and less than 8 inches.

In one embodiment, the centerline length of the section of tube forming a toroidal wedge of the plurality of toroidal wedges is less than the tube diameter of the portion of the torus.

In one embodiment, the section of tube forming a toroidal wedge of the plurality of toroidal wedges includes a layer of steel and a layer of copper.

In one embodiment, the thickness of the layer of copper is less than 10% of the thickness of the layer of steel.

In one embodiment, the non-conductive spacers are composed primarily of fiberglass reinforced plastic.

In one embodiment, the system includes an upper non-conductive support plate and a lower non-conductive support plate, configured to sandwich the assembly.

In one embodiment, the system includes a plurality of pins, wherein: the toroidal wedges of the plurality of toroidal wedges include a plurality of holes; the non-conductive spacers of the plurality of non-conductive spacers include a plurality of holes; and the upper non-conductive support plate and the lower non-conductive support plate include a plurality of holes located so as to be aligned with the holes in the toroidal wedges and the holes in the non-conductive spacers, and each of the plurality of pins is positioned in a hole in the upper non-conductive support plate or in the lower non-conductive support plate, and in a hole in a toroidal wedge or in a non-conductive spacer.

In one embodiment, the system includes a plurality of conductive bridges, a conductive bridge of the plurality of conductive bridges connected to a first toroidal wedge and to a second toroidal wedge, the first toroidal wedge, the conductive bridge, and the second toroidal wedge being thereby connected in series.

In one embodiment, the system includes a class E amplifier configured to drive a current through a toroidal wedge.

In one embodiment the system is configured to project an oscillatory magnetic field oscillating at a frequency in the range from 1 megahertz to 30 megahertz.

BRIEF DESCRIPTION OF THE DRAWINGS

Features, aspects, and embodiments are described in conjunction with the attached drawings, in which.

DETAILED DESCRIPTION

The detailed description set forth below in connection with the appended drawings is intended as a description of exemplary embodiments of a multisegmented toroidal magnetic field projector provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1:
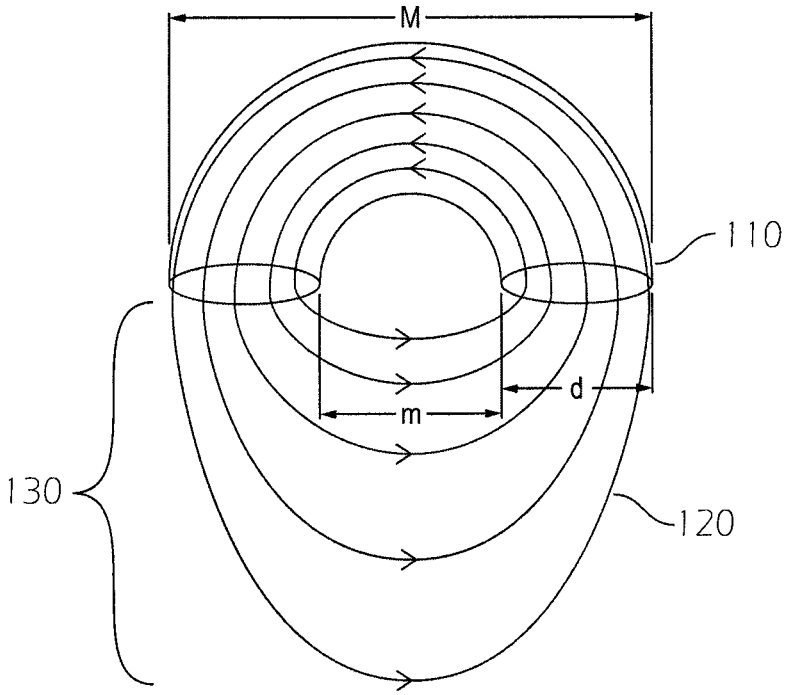
FIG. 1 is a perspective view of a conductor configuration in the shape of one-half of a torus, and of the magnetic field that results when a poloidal current flows in this conductor configuration, according to an embodiment of the present invention.

In toroidal magnetic devices, such as tokamaks, toroidal inductors, and toroidal transformers, a poloidal current flows around the outer surface of a torus, generating a toroidal magnetic field inside the torus. If the torus is formed as a surface of revolution by rotating a circle around the Z-axis, then the toroidal direction is one that is at each point perpendicular to the Z-axis and to a line from the Z-axis to the point, and the poloidal direction is, everywhere on the surface of the torus, perpendicular to the toroidal direction, i.e., it is tangential to the circle. The poloidal current may be carried, for example, by turns of wire wound in the poloidal direction around the surface of the torus. The lines of magnetic field in such a configuration are circles in the toroidal direction. Referring to FIG. 1, if a poloidal current flows instead in a half-torus 110 as illustrated, e.g., the upper half of a torus, the lines of magnetic field 120 are distorted from the circular shape they have in a full torus. In this configuration, the magnetic field is projected into the region 130 below the half-torus. The half-torus has a major diameter M, a minor diameter m, and a tube diameter d.

In one embodiment, such a magnetic field is used to trigger an IED, for example, by inducing a current in a conductive loop in the IED, heating a bridge wire within the detonator of the IED to a sufficiently high temperature to trigger a detonator in the IED. The magnetic field is an alternating field with a frequency in the range of 1 MHz to 30 MHz. This magnetic field has a near-field component and a radiated component; the radiated component corresponds to electromagnetic waves that radiate from the torus, carrying electromagnetic energy away.

Figure 2A:
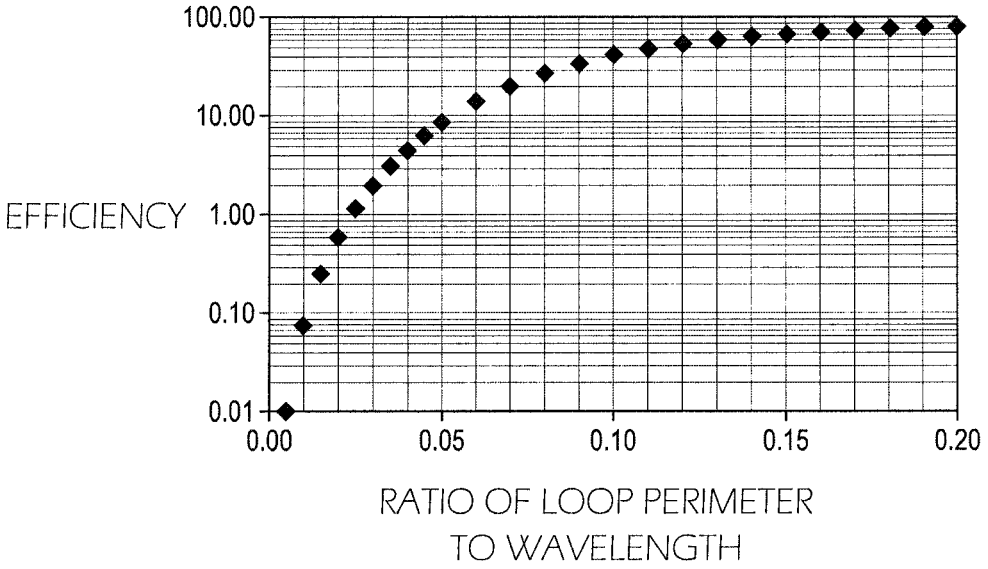
FIG. 2A is a graph of the approximate estimated efficiency of a half-torus as an antenna, according to an embodiment of the present invention.
Figure 2B:
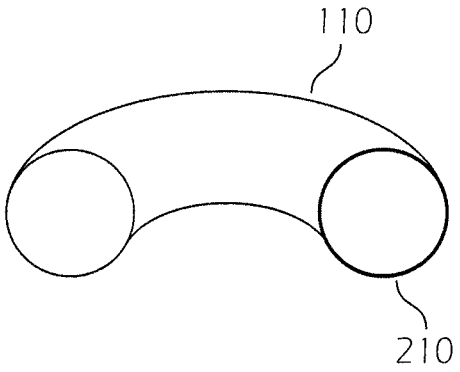
FIG. 2B is a perspective view of a half-torus illustrating the loop perimeter dimension, according to an embodiment of the present invention.

In an application in which the near-field component is used to trigger an IED, it may be advantageous for the near-field component of the magnetic field to be large compared to the radiated component. In FIG. 2A, the radiating efficiency of a loop of wire as an antenna is shown in a graph as a function of the ratio of the perimeter of the loop of wire to the wavelength of the radiated electromagnetic waves. This efficiency is thought to approximate the radiating efficiency of a half-torus having, for any point on the curve, the same ratio of loop perimeter 210 (the tube diameter times it) to the wavelength of the radiated electromagnetic waves. The graph shows, for example, that for a frequency of 27.12 MHz, corresponding to a wavelength of 11.1 m, and for a tube diameter of 5.8 inches, corresponding to a loop perimeter 210 of $\pi \times 5.8$ inches, or 0.46 m, for which the ratio of loop perimeter to wavelength is 0.04, the efficiency is estimated to be approximately 5%.

Figure 3A:
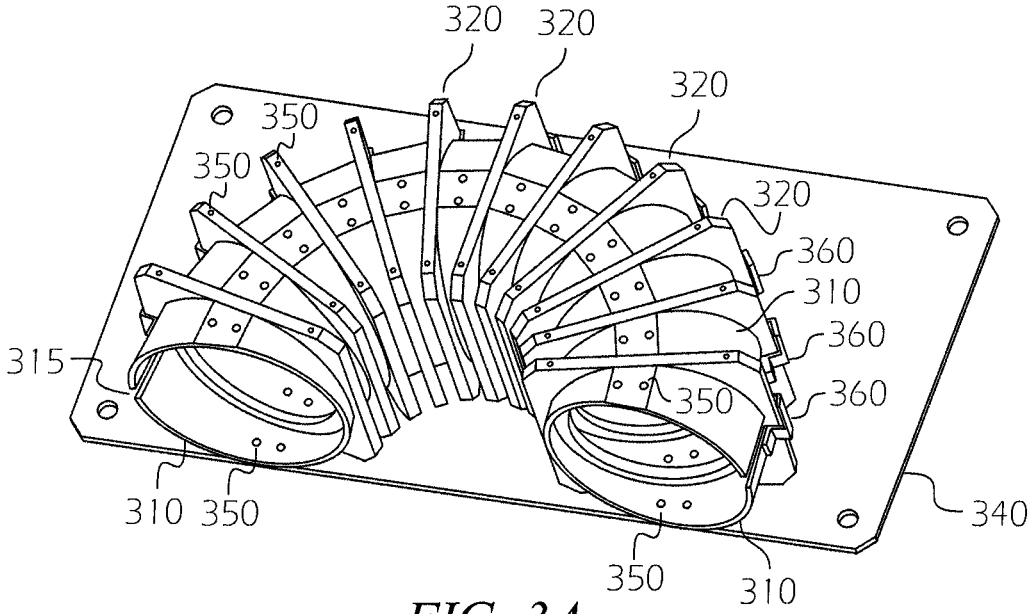
FIG. 3A is a perspective view of several conductive toroidal wedges arranged, on a lower non-conductive support plate, in a shape approximating a half-torus, according to an embodiment of the present invention.

Referring to FIG. 3A, in one embodiment, a system of conductors for carrying a poloidal field is constructed from a number of conductive elements referred to herein as toroidal wedges 310. Each toroidal wedge 310 has the shape of a short section of tube with two planar ends, the two planes not being parallel, so that in a suitable side view, taken from a direction perpendicular to the axis of the tube, the toroid wedge may appear as a trapezoid, or wedge. The toroidal wedge 310 has a slit 315 running from one end of the short section of tube to the other. Several toroidal wedges 310 are assembled end to end, separated by an insulating gap or insulating material, to form a shape approximating a half-torus as illustrated in FIG. 3A. The slit 315 in each toroidal wedge 310 may be used to drive a poloidal current through the toroidal wedge 310, e.g., by attaching two wires to the toroidal wedge 310, one on each side of the slit 315, and connecting the wires to a current source.

In one embodiment, the toroidal wedges 310 are formed by cutting short, wedge-shaped pieces from a round conductive tube or pipe, e.g., copper pipe. The tube has a centerline, or "axis" that is parallel to the wall (or walls, for, e.g., a square tube) of the tube, and runs along the center of the tube. Each cut is substantially planar and oblique to the centerline of the tube, i.e., the normal vector, or "normal", to the plane of the cut forms an angle, or "cut angle", with the centerline of the tube. The length of the tube measured along its centerline, i.e., the distance between the two points at which the centerline intersects the two respective cutting planes, is referred to as the centerline length of the toroidal wedge. In one embodiment, a plane parallel to the normals to the planes of the two cuts is also parallel to the centerline of the tube, and the cut angles are equal, for the two ends of each of the toroidal wedges 310, so that when one of the toroidal wedges 310 is viewed from the side, from a direction perpendicular to both normals, it appears in profile as a trapezoid. In one embodiment, the wedges are shaped and positioned such that the linear separation between two adjacent wedges is constant. After each piece is cut from the tube, a slit 315 may be formed at a point on the circumference of the piece, to provide attachment points for current drive conductors, such as wires. The toroidal wedges formed in this manner may then be assembled into a shape approximating, with a number of short, straight segments, the shape of a half-torus. The major and minor diameters of the half-torus will depend on the length of each toroidal wedge 310 (both the major and minor diameters being greater if the length is greater) and on the cut angles (both the major and minor diameters being smaller if the cut angles are greater), and the number of toroidal wedges 310 used to form a half-torus will depend on the cut angles (the number of toroidal wedges 310 being smaller if the cut angles are greater). In one embodiment, the tube is not round but has a different cross section, being, e.g., square, rectangular, or hexagonal, and a shape substantially in the shape of a portion of a torus is formed with pieces of tubing having cross sections that are not round. As used herein, a "torus" may have a circular cross section as in the embodiment illustrated in FIGS. 3A and 3B, or it may have a cross section that is not circular, e.g., square.

In another embodiment, a toroidal wedge 310 may be formed by rolling a flat piece of sheet metal, having two flat edges, and two edges each cut in the shape of a sinusoid, into a round shape so that the flat edges nearly meet.

Because the skin depth in copper at frequencies in the range between 1 MHz and 30 MHz is small, e.g., approximately 12 micrometers at 30 MHz, the toroidal wedge 310 may be composed of another material, e.g., steel, or a dielectric, with a thin coating of copper, which may be less than 10% of the thickness of the other material, and the toroidal wedge may nonetheless substantially maintain the electrical performance of a toroidal wedge composed of pure copper.

Figure 3B:
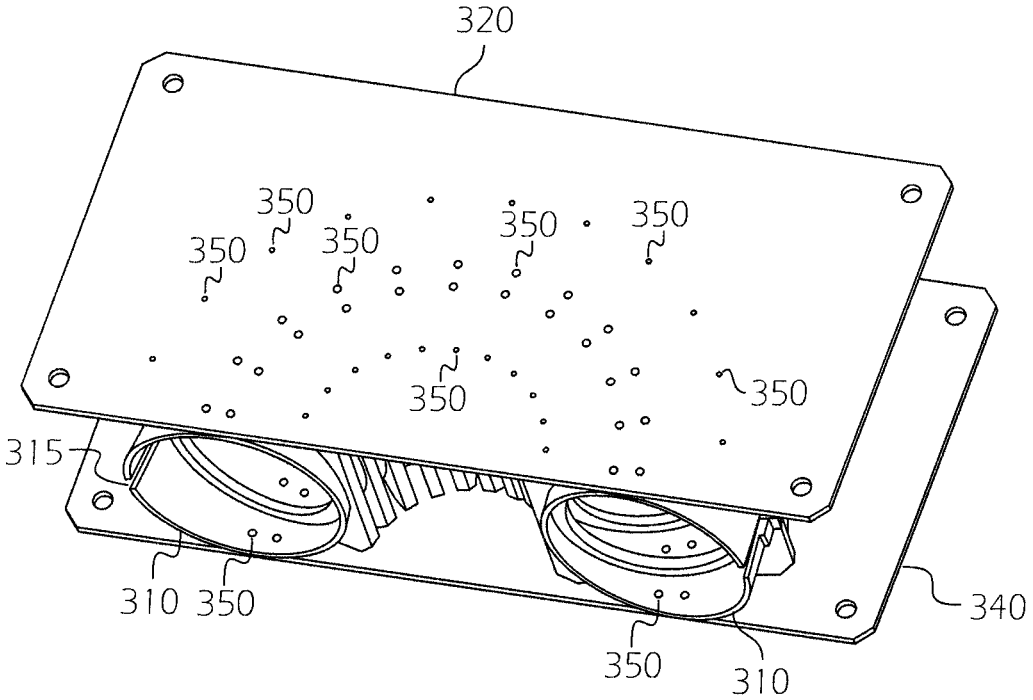
FIG. 3B is a perspective view of several conductive toroidal wedges arranged, between a lower non-conductive support plate and an upper non-conductive support plate, in a shape approximating a half-torus, according to an embodiment of the present invention.

Referring to FIGS. 3A and 3B, in one embodiment a set of toroidal wedges 310 is integrated with a support structure by stacking the toroidal wedges 310 alternately with non-conductive spacers 320 to form a toroidal assembly in a shape approximating a half-torus, and sandwiching the toroidal assembly between an upper support plate 330 and a lower support plate 340. The non-conductive spacers 320 may be composed of any suitable non-conductive material such as fiberglass reinforced plastic (FRP) (e.g., flame retardant FRP #4 or "FR-4"). They may be solid or have a central hole as shown in FIG. 3A. In one embodiment, they are approximately ¼ inch thick. The non-conductive lower and upper support plates may also be composed of FRP or any other suitable dielectric. In one embodiment, the non-conductive upper and lower support plates 330, 340 each has several holes 350 and the toroidal wedges 310 and the non-conductive spacers 320 have corresponding holes 350; pins are inserted through the upper and lower support plates 330, 340 and into the corresponding holes 350 in the toroidal wedges 310 and in the non-conductive spacers 320, to secure the parts in alignment with each other. In one embodiment, each non-conductive spacer 320 has four holes 350, two to receive pins inserted through the lower support plate 340, and two to receive pins inserted through the upper support plate 330, and each toroidal wedge 310 also has four holes 350, two to receive pins inserted through the lower support plate 340, and two to receive pins inserted through the upper support plate. Embodiments such as that illustrated in FIGS. 3A and 3B may consist entirely of low-cost components, so that the destruction of an assembly constructed according to one of these embodiments as a result of triggering an IED may be acceptable.

In one embodiment, 10 toroidal wedges are used to form an assembly approximating, i.e., substantially in the shape of, a half-torus. Each cut of each toroidal wedge may have a cut angle of approximately 9 degrees, so that the angle between the normals of the substantially planar ends of each toroidal wedge is approximately 18 degrees. Round tube with a diameter of approximately 6 inches forms each toroidal wedge, and the half-torus has a minor diameter of 6 inches and a major diameter of 18 inches. In other embodiments, more or fewer toroidal wedges are used to form the assembly. In one embodiment, 4 toroidal wedges are used and the angle between the normals of the substantially planar ends of each toroidal wedge is approximately 45 degrees.

In one embodiment, a conductive bridge 360 connects each toroidal wedge 310 to the two adjacent toroidal wedges 310, or, for the toroidal wedges 310 on the ends of the half-torus, to the adjacent toroidal wedge 310. Each conductive bridge 360 connects the conductor on the lower side of the slit 315 of one wedge to the conductor on the upper side of the slit 315 on an the adjacent wedge, so that the toroidal wedges 310 are all wired in series. A 100 ampere (A) current driven through the series circuit then results in each toroidal wedge 310 carrying 100 A. A class E amplifier may be used to drive current through the toroidal wedges and the conductive bridges in series. In another embodiment, each toroidal wedge 310 is separately driven, e.g., by a class E amplifier connected to the two sides of the slit 315.

In one embodiment, driving a current of 100 A through each of the toroidal wedges 310 results in a projected magnetic field having a value of at least 70 A-turns/m (ampere-turns per meter) within most of a volume measuring 5.8 inches×25.5 inches×15 inches, and capable of, e.g., triggering an IED buried within a corresponding volume of ground assuming the conductivity of the ground is sufficiently low, and that 70 A/m is sufficient to trigger the IED.

Figure 4A:
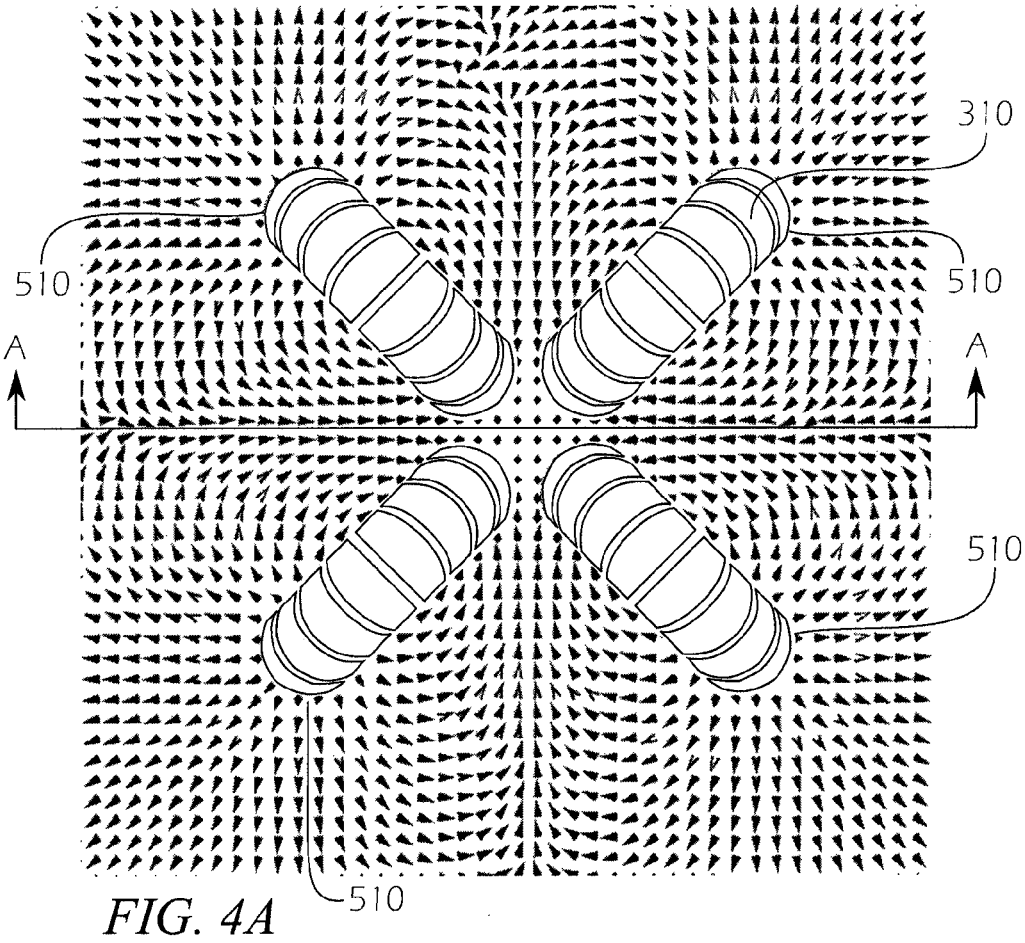
FIG. 4A is a top view of four half-torus assemblies combined in an "X" configuration, with a representation of the direction of the magnetic field they produce at one moment in time, in the plane defined by the exit mouths of each half-torus structure, according to an embodiment of the present invention.
Figure 4B:
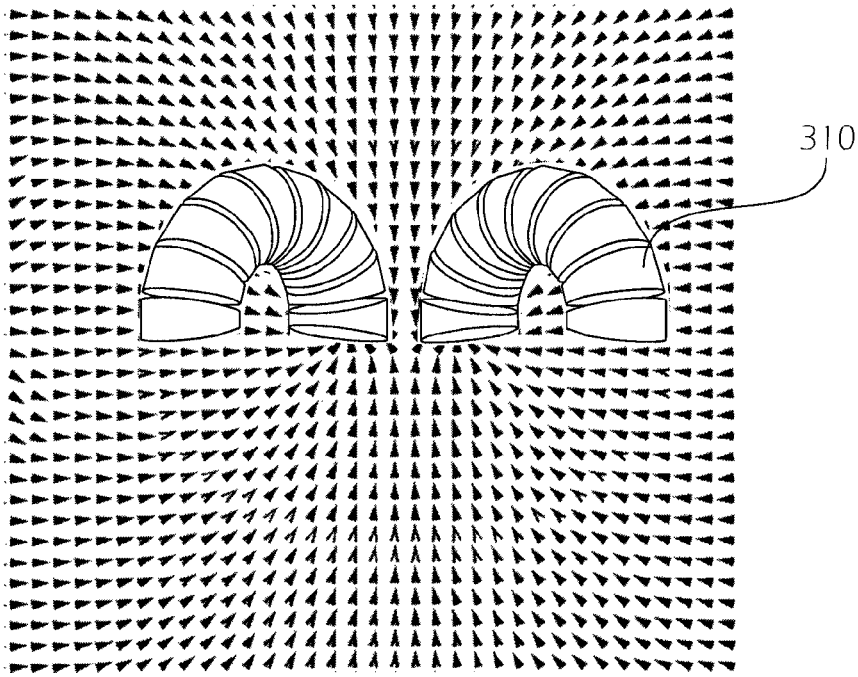
FIG. 4B is a front view of the four half-torus assemblies of FIG. 4A, with a representation of the direction of the magnetic field they produce at one moment in time, on the plane defined by section A-A of FIG. 4A, according to an embodiment of the present invention.

Referring to FIGS. 4A and 4B, in another embodiment four half-torus assemblies 510 are combined in an "X" configuration as shown, and driven with currents with phases suitable to cause the magnetic field to add in the volume into which the magnetic field projects. At the center of the "X" each half-torus is, in one embodiment, separated from its two nearest neighbors by approximately one-half the tube diameter, or by 3 inches. Such a configuration, when each toroidal wedge is carrying a current of 100 A, generates a projected magnetic field having a value of at least 70 A/m (amperes per meter) within most of a volume measuring 10.7"×36.6"×36.6".

FIGS. 4A and 4B also show the direction of the magnetic field vector for the "X" configuration at one moment in time; this direction is indicated at various points in FIGS. 4A and 4B by the direction of the arrowheads shown. The magnetic field is oscillatory; during a single cycle, the field at any point will eventually become zero and then reverse direction. The field shown in FIGS. 4A and 4B is a snapshot of the oscillatory field at a specific time. As can be seen from the top view of FIG. 4A and the front view of FIG. 4B, the region under the set of four half-torus assemblies has, at various points, a magnetic field with a significant vertical component, and significant horizontal components, so that a conductive loop in an IED may, regardless of the orientation of the conductive loop, enclose sufficient magnetic flux to result in high current in the loop, and to produce sufficient heating of the loop, to trigger the IED, for some position of the set of four half-torus assemblies relative to the conductive loop.

Figure 5:
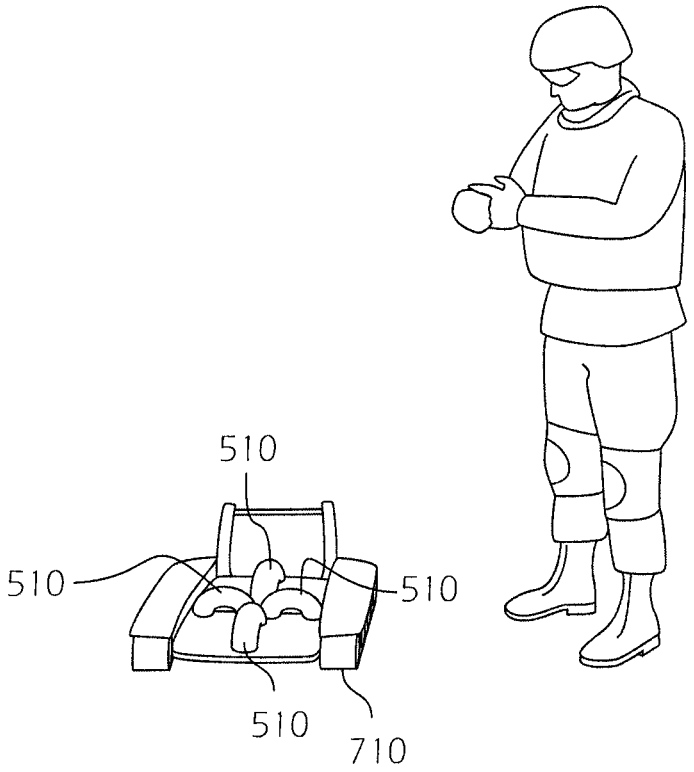
FIG. 5 includes a perspective view of a small robotic version containing a magnetic field projector according to an embodiment of the present invention.

Referring to FIG. 5, in one embodiment a set of four half-torus assemblies is integrated into a small, e.g., tracked or wheeled, robot 710 in an orientation such that the magnetic field projected from the set of four half-torus assemblies penetrates the ground under the robot 710 to trigger any IED that may be buried there. Such a robot 710 may be operated by remote control by a soldier following in the path of the robot 710 on foot, at a safe distance, for example.

Figure 6:
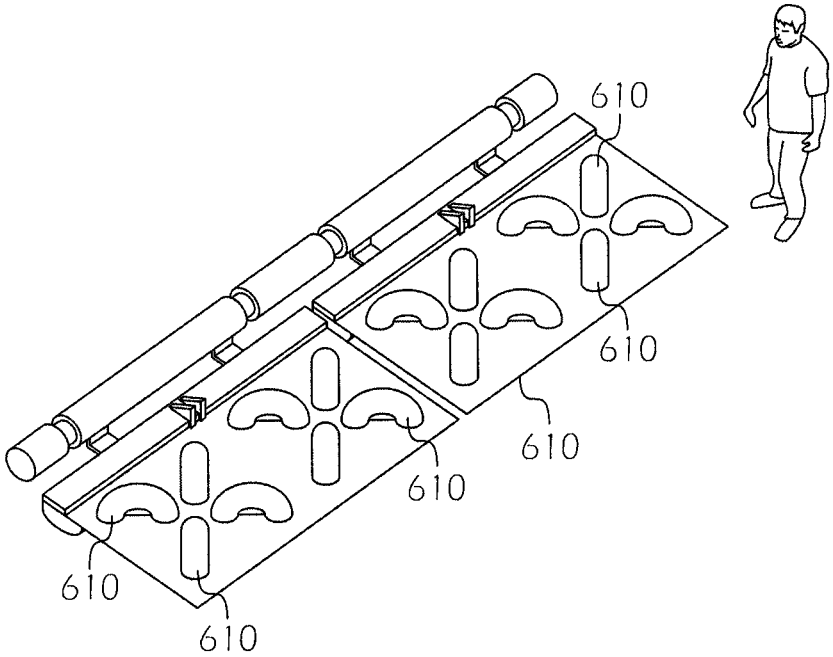
FIG. 6 includes a perspective view of a platform containing a magnetic field projector according to an embodiment of the present invention.

Referring to FIG. 6, in another embodiment several sets of four half-torus assemblies are arranged side by side on a platform 810 that may be attached to the front of a vehicle, such as an armored truck, that is sufficiently robust to withstand the detonation of an IED immediately in front of it. The vehicle is driven along any route suspected of having IEDs buried under it, to trigger the IEDs. High-value, or more vulnerable, parts of a convoy, such as soldiers on foot, may follow in the path of the truck. Each half-torus 610 is, in one embodiment, larger than a half-torus 510 of the embodiment of FIG. 5.

Although limited embodiments of a multisegmented toroidal magnetic field projector have been specifically described and illustrated herein, many modifications and variations will be apparent to those skilled in the art. For example, although the illustrated embodiments include toroidal wedges that are substantially identical, the toroidal wedges in an assembly may differ, being composed of different materials, for example. Accordingly, it is to be understood that the multisegmented toroidal magnetic field projector employed according to principles of this invention may be embodied other than as specifically described herein. The invention is also defined in the following claims, and equivalents thereof.

What is claimed is:

1. A system for projecting an oscillatory magnetic field, the system comprising:

a plurality of conductive toroidal wedges;

each toroidal wedge being a section of tube having two substantially planar ends, at least one of the substantially planar ends having a normal oblique to the centerline of the tube, the section of tube having a slit extending between the two substantially planar ends, and a plurality of non-conductive spacers;

the toroidal wedges being assembled to form an assembly substantially in the shape of a portion of a torus.

2. The system of claim 1, wherein the section of tube forming a toroidal wedge of the plurality of toroidal wedges has a cross section that is substantially circular.

3. The system of claim 1, wherein the section of tube forming a toroidal wedge of the plurality of toroidal wedges has a cross section that is substantially rectangular.

4. The system of claim 1, wherein the slit in the section of tube forming a toroidal wedge of the plurality of toroidal wedges is substantially parallel to the centerline of the section of tube.

5. The system of claim 4, wherein the slit in the section of tube forming a toroidal wedge of the plurality of toroidal wedges is substantially in a plane parallel to the normals of the substantially planar ends of the section of tube.

6. The system of claim 1, wherein the angle between the normals of the substantially planar ends of the section of tube forming a toroidal wedge of the plurality of toroidal wedges is less than 45 degrees.

7. The system of claim 1, wherein the angle between the normals of the substantially planar ends of the section of tube forming a toroidal wedge of the plurality of toroidal wedges is greater than 10 degrees.

8. The system of claim 1, wherein the minor diameter of the portion of the torus is greater than 4 inches and less than 8 inches.

9. The system of claim 1, wherein the major diameter of the portion of the torus is greater than 12 inches and less than 24 inches.

10. The system of claim 1, wherein the tube diameter of the portion of the torus is greater than 4 inches and less than 8 inches.

11. The system of claim 1, wherein the centerline length of the section of tube forming a toroidal wedge of the plurality of toroidal wedges is less than the tube diameter of the portion of the torus.

12. The system of claim 1, wherein the section of tube forming a toroidal wedge of the plurality of toroidal wedges comprises a layer of steel and a layer of copper.

13. The system of claim 12, wherein the thickness of the layer of copper is less than 10% of the thickness of the layer of steel.

14. The system of claim 1, wherein the non-conductive spacers are composed primarily of fiberglass reinforced plastic.

15. The system of claim 1, comprising an upper non-conductive support plate and a lower non-conductive support plate, configured to sandwich the assembly.

16. The system of claim 15, further comprising a plurality of pins, wherein:

the toroidal wedges of the plurality of toroidal wedges comprise a plurality of holes;

the non-conductive spacers of the plurality of non-conductive spacers comprise a plurality of holes; and the upper non-conductive support plate and the lower non-conductive support plate comprise a plurality of holes located so as to be aligned with the holes in the toroidal wedges and the holes in the non-conductive spacers, and each of the plurality of pins is positioned in a hole in the upper non-conductive support plate or in the lower non-conductive support plate, and in a hole in a toroidal wedge or in a non-conductive spacer.

17. The system of claim 1, further comprising a plurality of conductive bridges, a conductive bridge of the plurality of conductive bridges connected to a first toroidal wedge and to a second toroidal wedge, the first toroidal wedge, the conductive bridge, and the second toroidal wedge being thereby connected in series.

18. The system of claim 1, further comprising a class E amplifier configured to drive a current through a toroidal wedge.

19. The system of claim 1, configured to project an oscillatory magnetic field oscillating at a frequency in the range from 1 megahertz to 30 megahertz.

* * * * *